US006431262B1

(12) United States Patent
Tayali et al.

(10) Patent No.: US 6,431,262 B1
(45) **Date of Patent: *Aug. 13, 2002**

(54) THERMOSYPHON RADIATORS

(75) Inventors: Nkole Enock Tayali, Shepshed; Alan Reginald Shiret, West Bridgeford, both of (GB)

(73) Assignee: Lattice Intellectual Property Ltd., London (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/706,767

(22) Filed: Sep. 23, 1996

Related U.S. Application Data

(63) Continuation of application No. 08/391,677, filed on Feb. 21, 1995, now abandoned.

(30) Foreign Application Priority Data

Feb. 22, 1994 (GB) ..... 9403330

(51) Int. Cl.[7] ..... F28D 15/00

(52) U.S. Cl. ..... 165/104.26; 165/104.21; 165/133; 165/911

(58) Field of Search ..... 165/133, 104.26, 165/104.14, 46, 104.21, 104.19, 907, 911, 917; 62/527

(56) References Cited

U.S. PATENT DOCUMENTS

| | | | | | |
|---|---|---|---|---|---|
| 3,450,195 | A | * | 6/1969 | Schnacke | 165/104.26 X |
| 3,627,444 | A | * | 12/1971 | Lentz | 165/104.26 X |
| 3,656,545 | A | * | 4/1972 | van Loo | 165/104.26 X |
| 3,822,680 | A | * | 7/1974 | Showalter et al. | 165/104.26 X |
| 3,923,038 | A | * | 12/1975 | Cutchaw | 165/104.26 X |
| 4,046,136 | A | * | 9/1977 | Izumi et al. | 165/170 X |
| 4,088,118 | A | * | 5/1978 | Benseman | 165/104.14 X |
| 4,129,181 | A | * | 12/1978 | Janowski et al. | 165/133 |
| 4,219,078 | A | * | 8/1980 | Withers, Jr. | 165/133 |
| 4,231,423 | A | * | 11/1980 | Haslett | 165/104.26 X |
| 4,279,294 | A | * | 7/1981 | Fitzpatrick et al. | 165/46 X |
| 4,452,051 | A | * | 6/1984 | Berger et al. | 165/904 X |
| 4,640,347 | A | * | 2/1987 | Grover et al. | 165/104.26 |
| 4,715,433 | A | * | 12/1987 | Schwarz et al. | 165/911 X |
| 4,765,396 | A | * | 8/1988 | Seidenberg | 165/104.26 |
| 4,787,441 | A | * | 11/1988 | Granryd et al. | 165/133 |
| 4,883,116 | A | * | 11/1989 | Seidenberg et al. | 165/104.26 |
| 4,909,316 | A | | 3/1990 | Kamei | 165/104.26 |
| 5,058,196 | A | * | 10/1991 | Nakamura et al. | 165/133 X |
| 5,150,748 | A | * | 9/1992 | Blackmon et al. | 165/181 X |
| 5,156,208 | A | * | 10/1992 | Masuki et al. | 165/104.26 |

FOREIGN PATENT DOCUMENTS

| | | | | |
|---|---|---|---|---|
| DE | 41 24 507 | | 12/1992 | |
| EP | 0 177 660 | | 4/1986 | |
| GB | 631175 | | 10/1949 | |
| GB | 1064379 | | 4/1967 | |
| GB | 1 416 036 | | 12/1975 | |
| GB | 1 488 482 | | 10/1977 | |
| GB | 2099980 | | 12/1982 | |
| GB | 2 099 980 | | 12/1982 | |
| JP | 0074949 | * | 6/1977 | 165/181 |
| JP | 0162256 | * | 12/1979 | 165/907 |
| JP | 0013992 | * | 1/1987 | 165/104.26 |
| JP | 1042341 | * | 2/1989 | 165/133 |
| SU | 1112216 | * | 9/1984 | 165/911 |
| SU | 1643921 | * | 4/1991 | 165/133 |

* cited by examiner

*Primary Examiner*—Christopher Atkinson
(74) *Attorney, Agent, or Firm*—Larson & Taylor, PLC

(57) ABSTRACT

A thermosyphon radiator comprising a sealed panel containing a reservoir of water in a lowermost part of the panel and a heating member, e.g. a hot water pipe, extending through the lowermost part of the panel, the member being at least partially immersed in the liquid.

10 Claims, 1 Drawing Sheet

THERMOSYPHON RADIATORS

This application is a continuation of Ser. No. 08/391,677 filed Feb. 21, 1995 now abandoned.

This invention relates to thermosyphon radiators.

Thermosyphon radiators are the type in which a vaporising liquid contained within a sealed panel is heated, in use, by a heated pipe extending with clearance through the lowermost part of the panel. The liquid is vaporised and travels upwardly to the colder upper parts of the radiator where the vapour condenses giving out its latent heat of vaporisation into the radiator surface which is then convected to the air in a space, e.g. a room.

In one such type of radiator described in UK Patent No. 2099980B, the heating pipe is provided with a wick means in the form of a metal gauze depending therefrom, the pipe itself lying wholly above the level of a reservoir of the liquid. The wick dips into the liquid and continuously supplies a thin film of the liquid around the pipe for evaporation by the heated pipe to the upper parts of the radiator where the vapour condenses to give out its latent heat of evaporation to the radiator surface. The condensed liquid then trickles down the inside of the radiator and returns to its reservoir.

One problem with this type of system is that it is necessary to provide a wick to impart the necessary capillary action to draw the liquid up to the pipe increasing the cost of system. It is therefore an object of the present invention to provide a thermosyphon radiator without a wick.

According to one aspect of the present invention, we provide a thermosyphon radiator comprising a sealed panel containing a reservoir of vaporising liquid in a lowermost part of the panel and a heating member extending with clearance through the lowermost part of the panel, the member being at least partially immersed in the vaporising liquid.

The vaporising liquid may be water, but ammonia, methanol or acetone are viable alternatives.

According to another aspect of the present invention we provide a thermosyphon radiator comprising a sealed panel containing water in a lowermost part of the panel and a heating member extending with clearance through the lowermost part of the panel.

Preferably the member is a pipe for carrying a second liquid. Suitably the pipe is covered externally with a fine metallic mesh, compacted metallic wool, fibrous material or a polymeric coating. Alternatively the pipe can be coated with a porous material such as a sintered metallic or ceramic material.

Conveniently the pipe is immersed in the vaporising fluid, e.g. water to a depth of no less than three-quarters of the diameter of the pipe.

The panel may be of roll-bonded aluminium, which may be pretreated to inhibit corrosion.

The panel may be hermetically sealed and preferably is evacuated except for the vaporising liquid.

The radiator may be externally finned to increase the heat transfer to the space to be heated.

Suitably the water is distilled water and may contain corrosion inhibitors.

An embodiment of the invention will now be described by way of example only with reference to the accompanying drawings in which.

Figure 1:
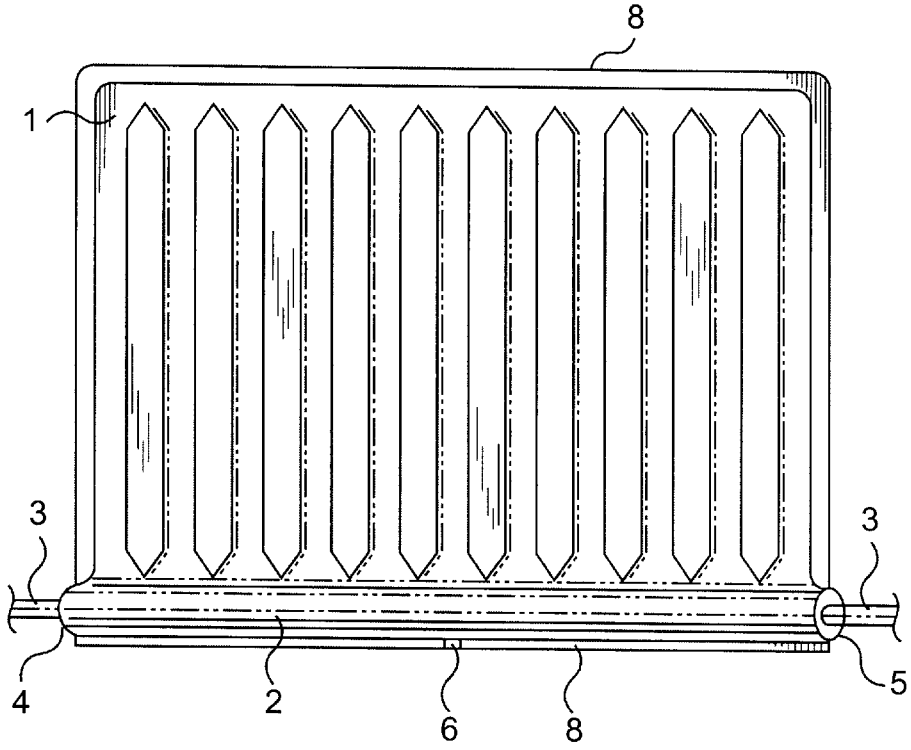
FIG. 1 is a perspective view of the radiator.

Referring to the drawings, the radiator comprises a conventional sealed panel 1 having a lowermost part 2 through which a pipe 3 enters at one side 4 and leaves by the other side 5. The pipe 3 may be a hot water pipe supplied with hot water from a boiler (not shown) and is joined to the panel 1. The panel 1 itself is hermetically sealed and evacuated except for the vaporising liquid.

Figure 2:
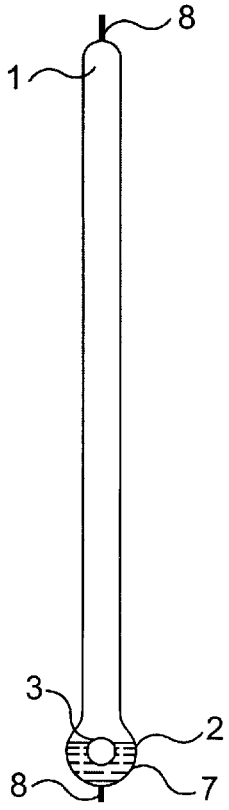
FIG. 2 is a cross-sectional view of the radiator.

The lowermost part 2 of the panel contains a reservoir 7 of water (FIG. 2) and the pipe 3, which as shown extends with clearance through the internal panel sides formed by the lowermost part 2, is immersed in the water to a depth of no less than three-quarters of the diameter of the pipe 3. The radiator is filled and then sealed for life by means of a preformed opening 6 at the bottom of the radiator. The opening is closed by using heat and pressure to bond the metal surfaces together.

When hot water at near boiling point passes through the pipe 3 the water begins to boil extracting latent heat from the pipe 3 and the vapour so produced rises to the upper part of the radiator panel where it condenses on the inside surface to give out its latent heat to the panel surface and therefore the space to be heated. The condensate then trickles back down to the reservoir 7. The external surface of the radiator panel 1 may be finned as indicated by fins 8 to assist heat transfer to the space to be heated.

What is claimed is:

1. A thermosyphon radiator comprising a sealed panel containing a reservoir of vaporizing liquid in a lowermost part of the panel and a pipe extending through the vaporizing liquid and extending only through the lowermost part of the panel with clearance, said lowermost part having first and second opposed ends and said pipe entering the first end and exiting through the second, opposed end, the pipe being coated externally with a coating without a downwardly depending wick, said coating comprising a ceramic porous material.

2. A radiator as claimed in claim 1 in which the pipe is at least partially immersed in the vaporizing liquid.

3. A radiator as claimed in claim 1 in which the vaporizing liquid comprises a liquid selected from the group consisting of water, ammonia, methanol and acetone.

4. A radiator as claimed in claim 3 in which the liquid comprises water.

5. A radiator as claimed in claim 1 in which the pipe has an external diameter and is immersed in the vaporizing liquid to a depth of no less than three-quarters of the external diameter of the pipe.

6. A radiator as claimed in claim 1 in which the panel is made of roll-bonded aluminum.

7. A radiator as claimed in claim 1 in which the panel is hermetically sealed.

8. A radiator as claimed in claim 1 in which the panel is evacuated except for the vaporizing liquid.

9. A radiator as claimed in claim 4 in which said water comprises distilled water.

10. A radiator as claimed in claim 1 in which the panel is externally finned.

* * * * *

UNITED STATES PATENT AND TRADEMARK OFFICE

CERTIFICATE OF CORRECTION

PATENT NO. : 6,431,262 B1
APPLICATION NO. : 08/706767
DATED : August 13, 2002
INVENTOR(S) : Tayali et al.

It is certified that error appears in the above-identified patent and that said Letters Patent is hereby corrected as shown below:

On the title page,
Item [*] delete "0" and insert --690--.

Signed and Sealed this

Fifth Day of December, 2006

JON W. DUDAS
*Director of the United States Patent and Trademark Office*